US005475955A

United States Patent [19]

Dickinson

[11] Patent Number: 5,475,955

[45] Date of Patent: Dec. 19, 1995

[54] INSULATING SYSTEM FOR ATTIC STAIRS AND THE LIKE

[76] Inventor: Thomas C. Dickinson, 711 E. Prospect, Hackettstown, N.J. 07840

[21] Appl. No.: 176,348

[22] Filed: Dec. 30, 1993

[51] Int. Cl.[6] ..... E04F 13/00

[52] U.S. Cl. ..... 52/202; 52/186; 182/46; 182/81

[58] Field of Search ..... 52/202, 67, 19, 52/309.8, 309.9, 309.13, 309.14, 404.1, 406.2g333.3, 186; 49/463, 466; 182/77, 81, 46

[56] References Cited

U.S. PATENT DOCUMENTS

| | | | |
|---|---|---|---|
| 2,330,941 | 10/1943 | Acuff . | |
| 4,151,894 | 5/1979 | Edwards | 49/463 X |
| 4,281,743 | 8/1981 | Fuller | 182/81 X |
| 4,312,423 | 1/1982 | Helbig | 182/8 X |
| 4,318,255 | 3/1982 | Long | 52/202 |
| 4,337,602 | 7/1982 | King | 52/202 |
| 4,550,534 | 11/1985 | Mariano et al. | 52/19 |
| 4,563,345 | 1/1986 | Stipe | 52/202 |
| 4,658,555 | 4/1987 | Steiner | 52/202 |
| 4,832,153 | 5/1989 | Daw et al. | 182/46 |
| 4,944,126 | 7/1990 | King | 52/202 |
| 5,271,198 | 12/1993 | Freeman | 52/202 |

OTHER PUBLICATIONS

Popular Science Oct. 1980 "Wordless Workshop".

*Primary Examiner*—Carl D. Friedman
*Assistant Examiner*—Robert J. Canfield
*Attorney, Agent, or Firm*—Eugene E. Renz, Jr.

[57] ABSTRACT

An insulating cover for an attic opening comprising a pair of telescoping male and female assemblies operable between a nested retracted position where they interengage and an extended position of a size to fit over the attic opening, each assembly comprising a top panel section, side panel sections depending from the top panel section and an end panel section along a closed end of the top panel section combined to form a hollow assembly and insulating material in the space of the hollow panel sections.

6 Claims, 3 Drawing Sheets

INSULATING SYSTEM FOR ATTIC STAIRS AND THE LIKE

FIELD OF THE INVENTION

The present invention relates to insulating materials and more specifically to a novel cover for effectively sealing the opening for a foldable stairway leading to the attic area of homes or the like.

BACKGROUND OF THE INVENTION

In recent times, public focus on saving energy has sharpened and consequently various new methods and materials have been devised to better insulate heated and air conditioned living spaces and the like. For example, new materials have been evolved to increase the "R" value in general and in some instances the depth of insulating material in attics or the like has been increased to achieve energy savings. However, notwithstanding these improvements, unless the living space is completely sealed, there are still leakage paths which can result in energy losses. For example, it has been found that the folding stairways for attic access in most instances remain uninsulated since the problem of insulating the space in a manner to still provide access is rather difficult. These areas provide a large opening through which heat losses can occur in the winter and cooled air can escape during the summer.

Attic hatchway covers or the like are not new per se. For example, various prior art types are shown in the patents listed below.

1. ACUFF, JR.
   INSULATION
   U.S. Pat. No. : 2,330,941
2. LONG ET AL.
   MODULAR INTERIOR STORM WINDOW AND HEAT TRAP
   U.S. Pat. No. : 4,318,255
3. STEINER
   ATTIC HATCHWAY INSULATING COVER
   U.S. Pat. No. : 4,658,555
4. DALEY
   ATTIC ACCESS STAIRWAY COVER
   U.S. Pat. No. : 4,928,441
5. KING ET AL.
   ATTIC INSULATING SYSTEM
   U.S. Pat. No. : 4,944,126

It has been found that while these prior covers are generally effective for the purposes intended, they are nevertheless bulky and rather difficult to manipulate and install and do not provide the optimum sealing characteristics.

SUMMARY OF THE INVENTION

With the foregoing in mind, it is an object of the present invention to provide a novel insulating cover for folding attic stairway wells or the like characterized by novel features of construction arrangement facilitating easy and economical assembly and installation.

To this end, the present invention comprises a pair of telescoping assemblies which nest together in one position to facilitate shipment which makes it more portable and easier to transport and which are easily actuateable to an extended position on the site for installation over an attic stair access opening. Each of the assemblies is characterized by lightweight, high R-value insulating materials and a sealing means for sealing the cover about its periphery over the opening in the stairwell opening.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
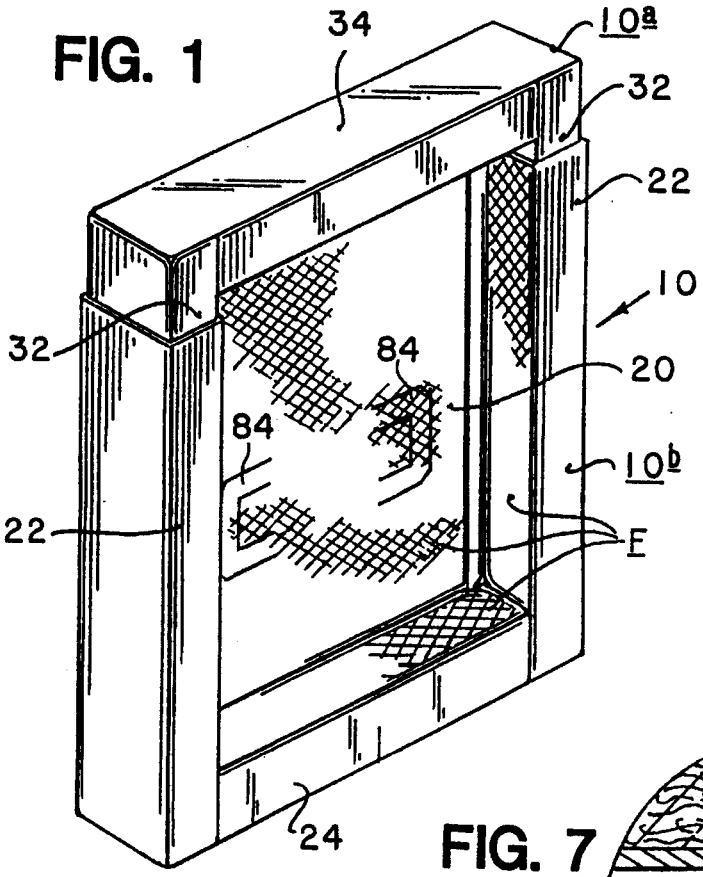
FIG. 1 is a perspective view of a folding attic stair insulating assembly in a collapsed or shipping mode in accordance with the present invention.
Figure 7:
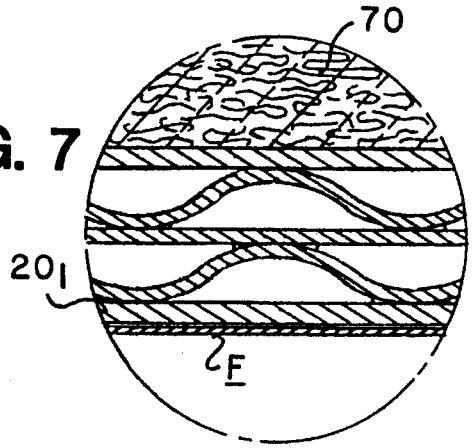
FIG. 7 is a enlarged fragmentary sectional view of the detail contained within the dot and dash circle shown in FIG. 5 and designated FIG. 7 showing the layered insulating materials facing the stairwell opening.

Referring now to the drawings, there is illustrated a folding attic stair insulating assembly generally designated by the numeral 10 made in accordance with the present invention. The assembly comprises two telescoping male and female assemblies $\mathbf{10}^a$ and $\mathbf{10}^b$ which are positionable between a nested position shown in FIG. 1 and in an extended or open position shown in FIG. 2 ready to be positioned over an opening 0 for a folding attic stairway (see FIG. 5). The nested position facilitates shipping and handling and also conserves shelf or storage space in retail establishments selling the product. The male and female assemblies $\mathbf{10}^a$ and $\mathbf{10}^b$ are generally of the same configuration and may be made of a lightweight cardboard material. Other suitable lightweight materials may be used, such as corrugated polypropylene. The sections are hollow to permit filling with a suitable core insulating material.

Figure 2:
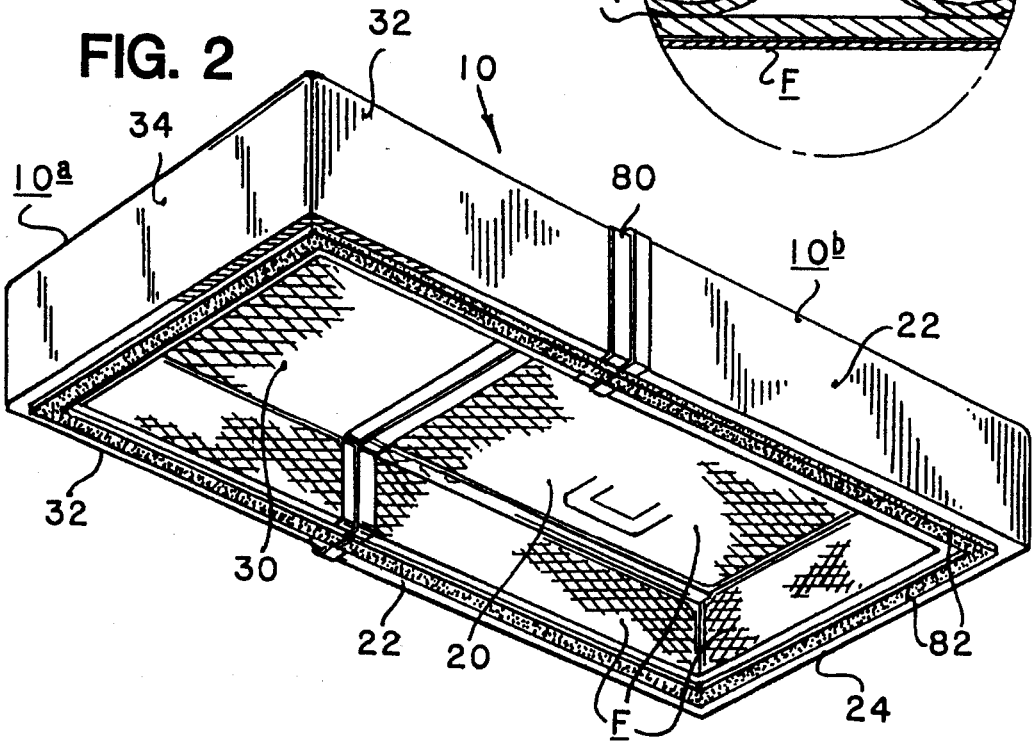
FIG. 2 is a perspective view of the attic stair insulating assembly in an extended ready to use position.
Figure 3:
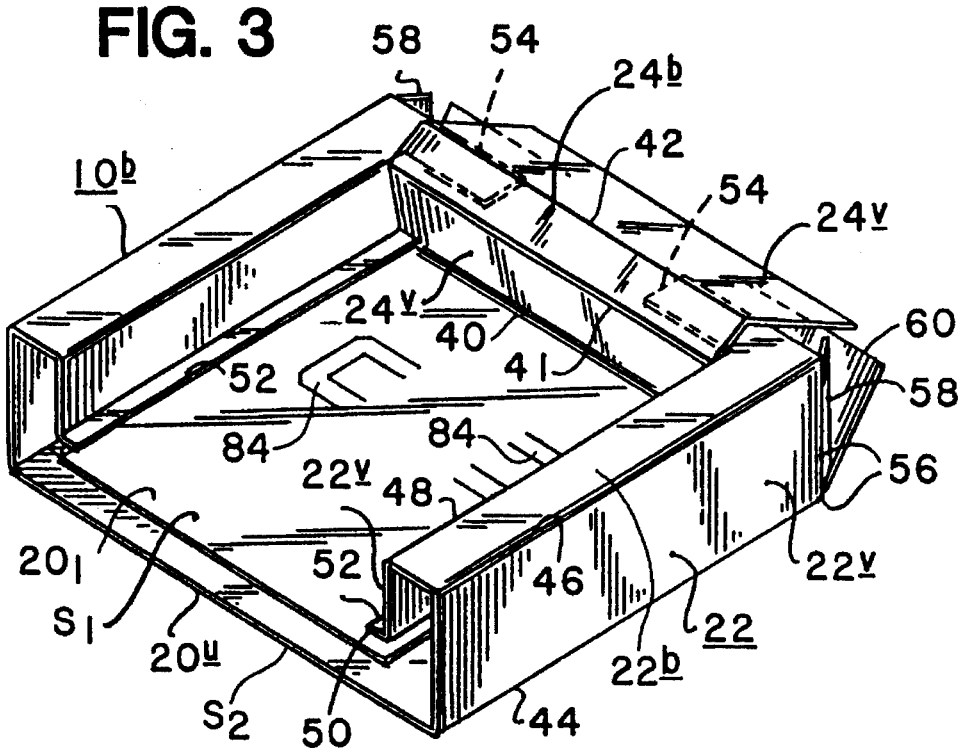
FIG. 3 is an isometric view schematically illustrating the parts of the female assembly of the present invention.
Figure 4:
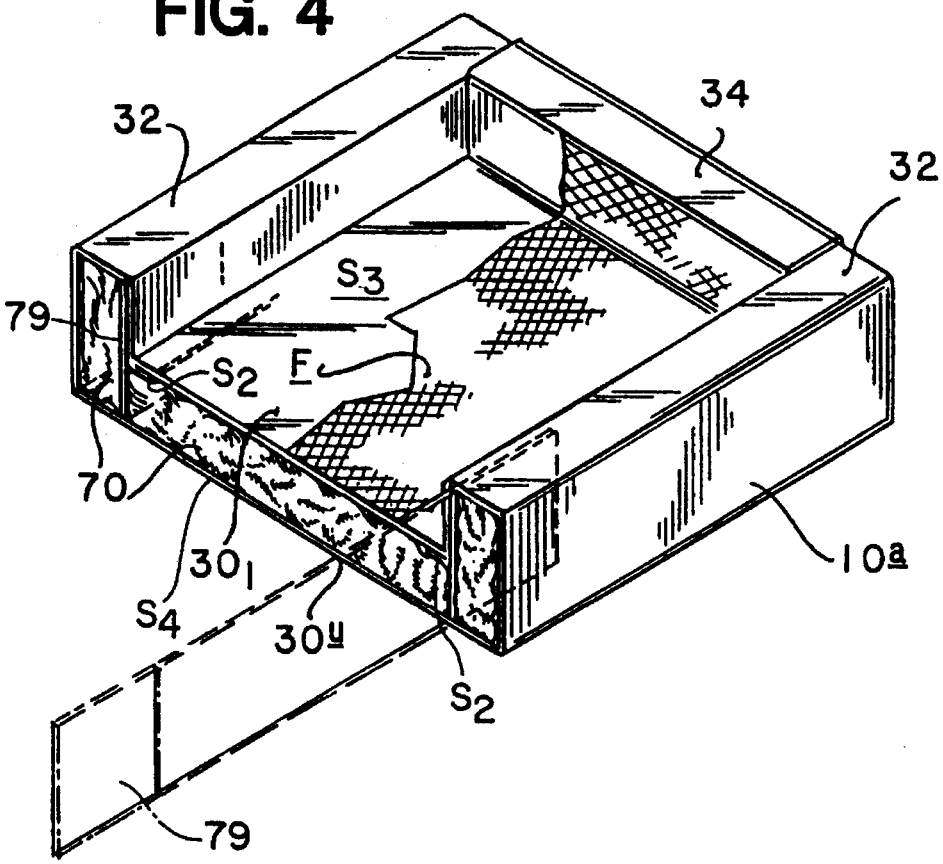
FIG. 4 is an isometric view showing the male assembly.
Figure 5:
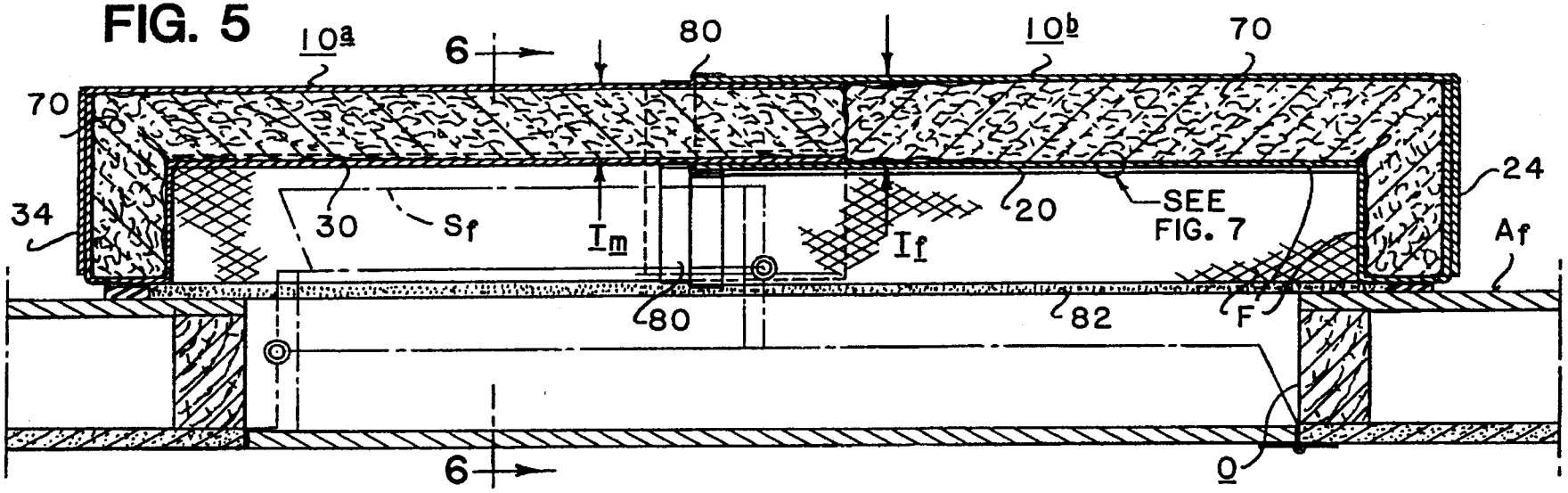
FIG. 5 is an enlarged fragmentary longitudinal sectional view showing the attic stair insulating assembly positioned over an opening leading to the attic.

Considering now more specifically the structural details and arrangement of the present invention as shown in FIG. 2, 3 and 4 the female assembly $\mathbf{10}^b$ includes a generally rectangular hollow top panel section 20, a pair of hollow side panel sections 22 depending from opposing sides of the hollow top panel section 20 and a hollow end panel section 24 depending from the top panel section 20 and extending between the outer ends of the side panel sections 22. The telescoping male assembly $\mathbf{10}^a$ is of a similar configuration comprising a hollow top panel section 30, hollow side panel sections 32 and a hollow end panel section 34. However, as shown in FIG. 5 the cross sectional thickness $T_m$ of the panel sections of the male assembly $\mathbf{10}^a$ is slightly narrower than the cross sectional thickness $T_f$ of the female assembly to permit the nesting and telescoping of the male and female assemblies in the manner illustrated in FIG. 1 and FIG. 2.

The male and female assemblies $\mathbf{10}^a$ and $\mathbf{10}^b$ can be fabricated from sheets of cardboard material or the like, cut and scored in a predetermined manner as illustrated in FIGS. 3 and 4. Considering first the female assembly shown in FIG. 3, this assembly comprises a first elongated rectangular sheet $S_1$ scored along transverse bend lines 40, 41, and 42 which when folded as shown in FIG. 3 defines the lower face $\mathbf{20}_l$ of the top panel section 20 and the bottom $\mathbf{24}_b$ and two vertical end walls $\mathbf{24}_v$ of the end panel section 24. A second generally rectangular sheet $S_2$ is cut and scored with both transverse and longitudinally extending score lines so that when folded as shown in FIG. 3 defines the upper face $\mathbf{20}_u$ of the top panel section 20. Longitudinally extending score lines 44, 46, 48 and 50 define the bottom $\mathbf{22}_b$ and vertical side walls $\mathbf{22}_v$ of the side panel sections 22 and the inner longitudinally extending flanges 52 to which the lower face $\mathbf{20}_l$ is secured. The second sheet $S_2$ is also provided with a pair of transversely extending projections 54, which aid in forming the end panel section 24. In addition, a transverse score line 56 is provided to define end tabs 58. Outer end flap 60 of the end panel section 24 envelopes end tabs 58. The two erected sheets $S_1$ and $S_2$ are joined together by suitable means, such as staples. The spaces thus formed between the walls defining the panel sections are filled with a suitable insulating material to improve the insulating quality of the assembly. The lower face $\mathbf{20}_l$ (see FIG. 3) and $\mathbf{30}_l$ (see FIG. 4) of the top panel section of male and female assemblies may be provided with a sheet of foil F to provide a reflective surface. If desired the entire outer peripheral surface of the male and female assemblies may be covered with the foil F.

The male assembly $\mathbf{10}^a$ shown in FIG. 4 may likewise be formed of two sheets $S_3$ and $S_4$ in a manner similar to that of the female assembly described above. However, the flange 52 in the male assembly underlies the lower face $\mathbf{30}_l$ of the top panel section to prevent gaping when the male and female assemblies are telescopically interengaged.

Further, the male assembly $\mathbf{10}^a$ is provided with braces 79 at the juncture of the side panel sections and top panel to prevent bowing of the top panel section during assembly of the male and female assemblies. More specifically, the brace 79 comprises an insert which extends the full vertical depth of the end panel section and extends inwardly approximately ten (10) inches from the open end of the male assembly $\mathbf{10}^a$.

The male and the female assemblies $\mathbf{10}^a$ and $\mathbf{10}^b$ are nested and the assembly is ready for shipment to the user. It is noted that as the male assembly $\mathbf{10}^a$ is pushed into the female assembly $\mathbf{10}^b$, the compressible insulation within the filled hollow panel sections of the female assembly $\mathbf{10}^b$ is compressed by the insertion therein of the corresponding compressible insulation filled male hollow panel sections of the male assembly $\mathbf{10}^a$, until the assembly 10 is in its compact, nested position as shown in FIG. 1.

Consider now use of the stairwell insulating assembly of the present invention. The user simply places the assembly on a level surface with the female assembly $\mathbf{10}^b$ facing downwardly as in FIG. 1. The user then places light pressure with one foot on the end panel section 24 of the female assembly $\mathbf{10}^b$ to steady it while pulling the male assembly $\mathbf{10}^a$ upwardly to a point where both assemblies are separated completely. The insulation inside the female assembly $\mathbf{10}^b$ will be compressed and therefore, the user reaches inside to pull the insulation until it extends to a predetermined mark adjacent the inner wall of the unit. It is noted that the insulation should not be extricated beyond the mark inside the female assembly $\mathbf{10}^b$ for proper insulating value. It is further noted that the insulation in the male assembly $\mathbf{10}^a$ should not be compressed. However, the user should note that the insulation in the male assembly $\mathbf{10}^a$ extends out to the outer edge of the open end thereof as generally designated by the numeral 70.

The assemblies are then rejoined by sliding the male assembly $\mathbf{10}^a$ into the female assembly $\mathbf{10}^b$ so they are in the relative position shown in FIG. 2. The male and female assemblies $\mathbf{10}^a$ and $\mathbf{10}^b$ are assembled together until they measure approximately fifty-four (54) inches from confronting inner vertical walls of the end panel sections 24 and 34. The male and female assemblies so interengaged will overlap each other at the seam when rejoined as illustrated in FIG. 5. Fifty-four (54) inches is the standard length of most attic stair rough openings.

The assemblies are then laid on a flat surface and a spacer is placed under and along the entire far edge of the male assembly. Pressure sensitive tape 80 is then applied to the joints as shown in FIG. 2 to completely seal the juncture of the assemblies at their open ends. The overlapping faces of the side panel sections of the male and female assemblies may be secured together by fasteners to prevent flexing of the male and female assemblies when completely assembled as shown in FIG. 2. The assembled unit will handle much like an integral one piece assembly. After taping inner and bottom sections of the joint, turn the assembly over and again place spacers under the male assembly $\mathbf{10}^a$. Tape the remaining sections first following with the top then tape the remaining sections along the side.

Figure 6:
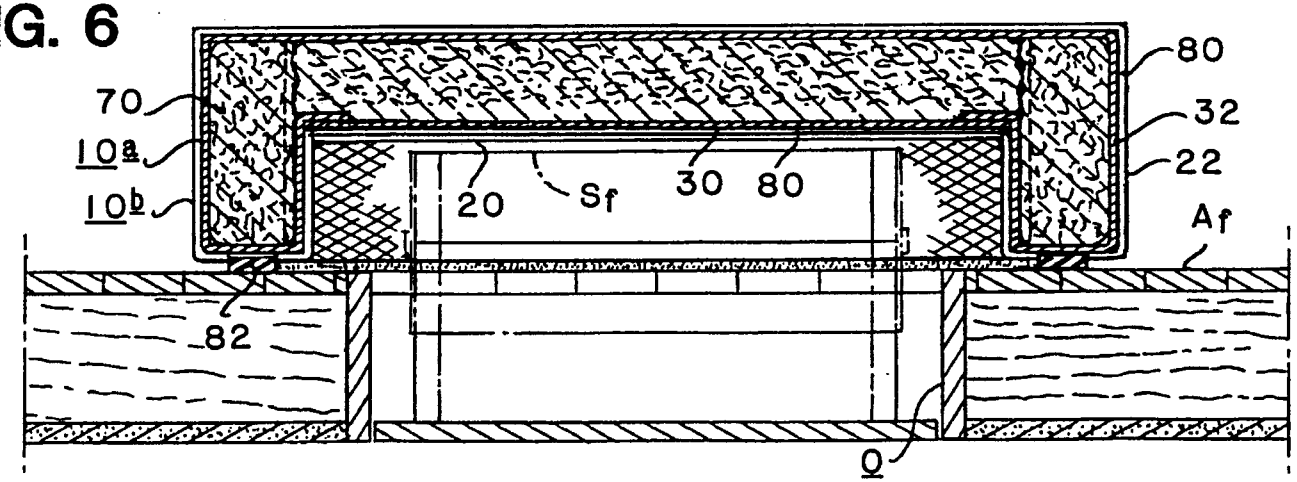
FIG. 6 is an enlarged sectional view taken on lines 6—6 of FIG. 5.

The unit is now ready for installation. Install by simply placing it over the attic stair rough opening 0 so that it is centered. The user then determines the proper location for the weather stripping 82. Depending on a particular installation, the weatherstripping 82 should be located where it best seals off the open air space. Weatherstripping 82 is then applied on the bottom face of the side and end panel sections to improve the seal when the unit is positioned over an opening in the attic in the manner shown in FIG. 5 and 6. It is noted that the weatherstripping used consists of two different thicknesses. The thicker stripping should be used on the male assembly $\mathbf{10}^a$ of the unit since it will compensate for the offset and size difference between the two assemblies.

The lower face of each male and female assemblies may be provided with a die cut handle 84 to aid the user in positioning the assembly in place and also for opening and closing purposes. (See FIG. 2).

Even though a particular embodiment of the present invention has been illustrated and described herein, it is not intended to limit the invention and changes and modification may be made therein within the scope of the following claims.

What is claimed is:

1. An insulating cover for an attic opening comprising:

a pair of male and female assemblies operable between a nested, retracted position whereby said male and female assemblies slidingly interengage with one another, to form an extended position of a size to fit over the attic opening; each said assembly comprising a hollow top panel section; hollow side panel sections depending from said top panel section; and a hollow end panel section along an end of said top panel section and connecting said side panel sections; and compressible insulating material within said hollow top, side and end panel sections of each said assembly whereby said interengagement of said assemblies to form said nested position substantially compresses said insulating material within said hollow top and side panels of said female assembly.

2. The insulating cover as claimed in claim 1, further including seal means around the periphery of said extended position of said male and female assemblies for sealing said assemblies and the attic opening.

3. The insulating cover as claimed in claim 1, wherein said male and female assemblies are made of polypropylene.

4. An insulating cover for an attic opening comprising;

a pair of male and female assemblies operable between a nested, retracted position whereby said male and female assemblies slidingly interengage with one another to form an extended position of a size to fit over the attic opening, each said assembly formed of two sheets cut and scored in a predetermined manner to define a hollow top panel section, a pair of hollow side panel sections depending from opposing sides of said hollow top panel section, and a hollow end panel section connecting said hollow side panel sections; and compressible insulating material within said hollow top, side and end panel sections of each said assembly.

5. The insulating cover as claimed in claim 4, including at least one handle on a face of said hollow top panel section of at least one of said male and female assemblies to aid in manipulating the insulating cover.

6. An insulating cover as claimed in claim 4, wherein the cross sectional width of said hollow panel section of said male assembly is less than the cross sectional width of said hollow panel section of said female assembly to permit nesting and sliding interengagement of said male and female assemblies.

* * * * *